United States Patent [19]

Sessions

[11] 4,357,911

[45] Nov. 9, 1982

[54] RAPID RECOVERY HOT WATER BOILER

[76] Inventor: Byron J. Sessions, 4939 Havasu Way, Salt Lake City, Utah 84120

[21] Appl. No.: 221,350

[22] Filed: Dec. 29, 1980

[51] Int. Cl.[3] ..... F22D 1/28

[52] U.S. Cl. ..... 122/441

[58] Field of Search ..... 122/441, 442, 14

[56] References Cited

U.S. PATENT DOCUMENTS

| | | | |
|---|---|---|---|
| 278,196 | 5/1883 | Stilwell | 122/442 X |
| 1,255,602 | 2/1918 | Harrison | 122/441 |
| 4,224,981 | 9/1980 | Datz | 122/441 X |

*Primary Examiner*—Edward G. Favors

*Attorney, Agent, or Firm*—K. S. Cornaby

[57] ABSTRACT

A steam boiler for use in small industry or business comprising in combination a holding tank and steam generation unit. Water from the holding tank flows into the steam generation unit at the same rate that steam exits the unit thereby maintaining a constant amount of water in the steam generation unit. The steam generation unit has a small water reservoir for producing steam rapidly when heat is applied by a burner. Steam exits the generation unit through a pipe which passes through the holding tank, thereby heating water in the holding tank and reducing the heat needed to generate steam. The steam exits the holding tank and is preferably directed back through the burner to be reheated before use.

6 Claims, 4 Drawing Figures

RAPID RECOVERY HOT WATER BOILER

BACKGROUND OF THE INVENTION

This invention relates to high pressure steam boilers for use in light industry plants or portable steam generating facilities to provide heat by conduction of the steam or for the purpose of utilizing its energy for the production of mechanical work.

Energy shortages and rapidly increasing energy costs have created a need for an improved steam boiler which minimizes the amount of energy required to generate the necessary steam without sacrificing the nearly instantaneous production of steam accommplished by present boilers. The present apparatus is adapted to generate steam from a small reservoir, thereby minimizing the amount of energy needed to produce the steam and further decreasing the lapse time until steam is available for use.

It is therefore an object of this invention to provide an improved and less expensive means for rapidly generating steam to supply heat or to produce mechanical work.

SUMMARY OF THE INVENTION

The apparatus of the present invention has a preferably cylindrical housing means or holding tank made of a suitable material having great tensile strength, such as steel or the like. Disposed within the housing is a series of vertically-spaced lateral baffles designed to maintain a more uniform water temperature within the housing.

Below the housing is a steam generation unit having a rapid heat chamber means. Water from the housing reservoir flows through a control valve to a smaller reservoir in the heat chamber means. The water level in the heat chamber reservoir is maintained at a level sufficient to form a hollow cavity inside the heat chamber. Pipe means for steam removal having one end in the cavity of the heat chamber extends upwardly through the housing reservoir to an upper cavity in the housing means. Thus when heat is applied to the heat chamber means from external burner means the water in the cavity is heated to produce steam, which flows through the pipe means. Some of the heat energy from the rising steam in the pipe means is lost to the surrounding water of the housing reservoir, thereby raising the temperature of that water and reducing the amount of energy required to subsequently transform the water into steam in the heat chamber.

The upper end of the steam pipe means protrudes above the water level of the housing unit and has a cap over it on which water vapor condenses and falls back into the housing reservoir. The remainining stream enters a steam outlet provided at the upper surface of the housing means hollow cavity, and may be used without further treatment, or channeled back through the burner means to be reheated before being used for heating purposes or providing mechanical work.

THE DRAWINGS

The preferred mode for carrying out the invention is illustrated in the accompanying drawings, in which:

FIG. 1 is a side elevational view of the apparatus of the present invention;

FIG. 2, a partial top plan view of a baffle having a steampipe through its center;

FIG. 3, a top plan view of three steam generating units in combination rising a common heat chamber; and FIG. 4, is a side elevational view of the three steam generating units in combination shown in FIG. 3.

DETAILED DESCRIPTION OF THE PREFERRED EMBODIMENT

Figure 1:
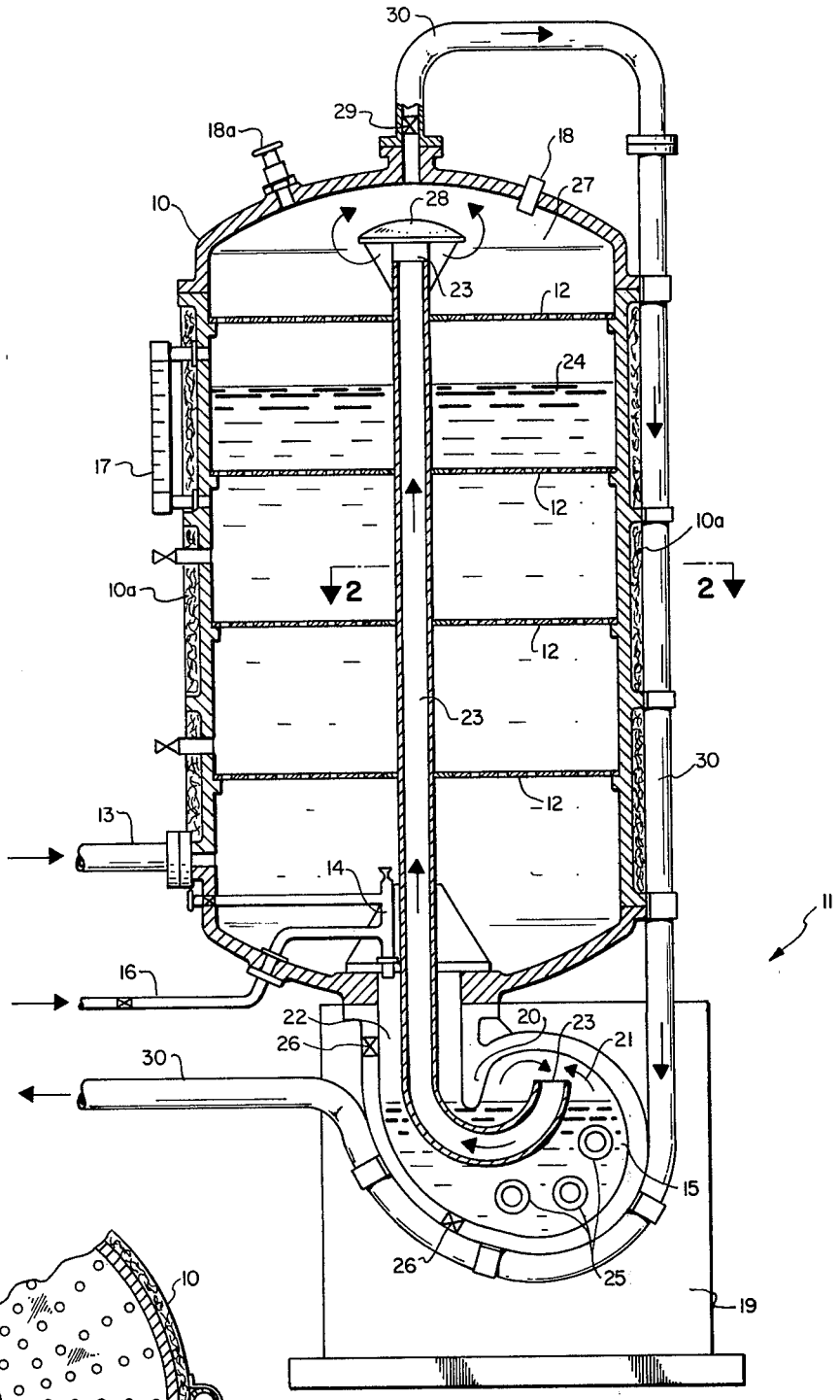
Figure 2:
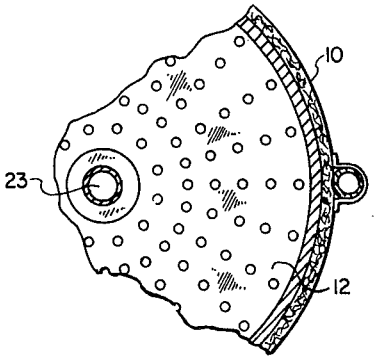

As shown in FIG. 1 of the drawings, a preferred embodiment of the steam boiler apparatus of the present invention has a housing tank 10 in the general shape of a cylinder which is constructed of a suitable material such as high strength steel or the like and is surrounded by an insulating material 10*a*. Housing 10 functions as a large reservoir of heated water to be used in a steam generation unit 11 for the production of steam. An even temperature of water is maintained in housing tank 10 by means of a series of lateral baffles 12 disposed in a vertically-spaced apart relationship with each other, as shown in FIG. 2. Water temperature is maintained or increased during the steam generation process as described below.

Water is supplied to holding tank 10 from an external source through an input pipe 13. An automatic or manually controlled check valve 14 regulates water flow from tank 10 to steam generation unit 11 to maintain a constant water level in a heat chamber reservoir 15. In addition, water can be introduced directly into steam generation reservoir 15 through pipe 16 if the water level falls too low. All input water lines have check valves to prevent backflow of water. A water level guage 17, a steam pressure guage 18, and appropriate steam pressure relief valves, such as shown at 18*a* of FIG. 2, are provided on the exterior of the housing 10 to assist the operator in determining water and steam pressure levels. Of course, other water level and steam pressure measurement devices, such as electronic measuring means, can be employed.

Steam generation unit 11 is disposed preferably below and in communication with housing 10 and comprises a heat chamber 15 and a burner 19 suitable for use with any type fuel, for example gas or coal. Extending downwardly from the upper surface of steam generation reservoir 15 is a protrusion 20 which divides reservoir 15 into a steam generation chamber 21 and a storage reservoir 22 for water coming from either housing tank 10 or input line 16. A steam pipe 23 protrudes above the water level into chamber 21 and extends upwardly through holding tank 10 above the water level 24 of tank 10. As shown in FIG. 2, steam pipe 23 is secured in a relatively immobile position in baffles 12 through which it passes. Stay nipples 25 are preferably provided through steam generation reservoir 15 to allow heated air to pass through reservoir 15, thereby providing more efficient and rapid heating of the water. The walls of reservoir 15 are provided with one or more safety plugs 26 which may be of lead or the like to blow out and prevent overheating of the heat chamber in the event that the heat chamber does not have water in it.

In use, water is introduced to holding tank 10 through pipe 13 and to steam generation reservoir 15 through pipe 16 to maintain the water content at the desired levels. Heat is applied to steam generation reservoir 15 by burner 19, and valve 14 is adjusted such that water flows from holding tank 10 to reservoir 15 at a rate equal to the amount of water leaving reservoir 15 in the form of steam. As steam is rapidly produced through the heating of water in reservoir 15 by burner 19, it is forced into the open end of steam pipe 23 which is disposed in cavity 21 above the water level of steam generation reservoir 15. As the steam travels through steam pipe 23 some of its heat is lost to the water in holding tank 10, thereby heating that water and reducing the amount of heat needed to bring the water to steam generation temperature when the water reaches reservoir 15. Baffles 12 cause the heated water within holding tank 10 to distribute evenly throughout the tank. A series of valves along tank 10 permit the water level and temperatures to be checked manually within areas between baffles 12.

As steam exits the upper end of steam pipe 23 into a cavity 27 above the water level of tank 10, it encounters a cap 28 affixed above the open upper end of pipe 23. Lower temperature steam condenses and falls back into holding tank 10. The remaining higher-temperature steam enters a steam outlet valve 29 into a steam discharge pipe 30. Steam discharge pipe 30 conducts the steam directly to its ultimate use, or preferably back through burner 19 along the outer surface of chamber 15, before it is finally discharged through pipe 30 to provide heat or mechanical work.

Figure 3:
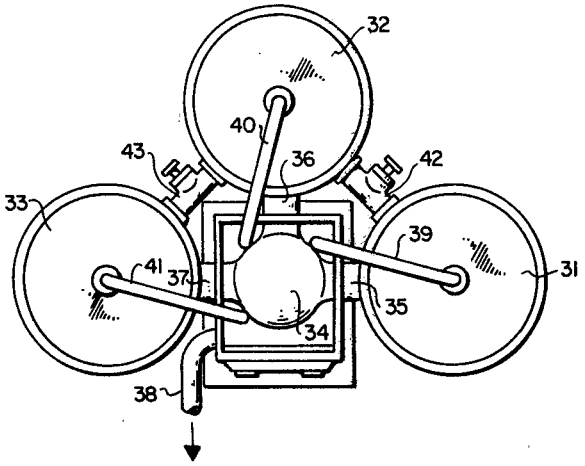
Figure 4:
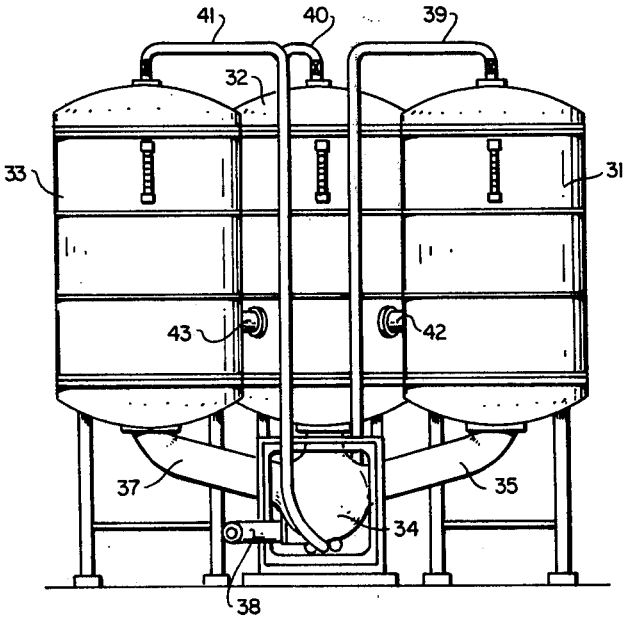

As shown in FIGS. 3 and 4 the apparatus of the present invention can be used in combination to provide an increased quantity of steam. Three holding tanks 31, 32, and 33 are connected to a single steam generation unit 34 through water flow pipes 35, 36, and 37. Each unit generates steam in the manner described hereinabove, the only necessary changes being that a service pipe 38 of increased diameter is required to collect the steam from individual discharge pipes 39, 40 and 41. As shown, if desired, interconnecting valved water pipes 42 and 43 between tanks 31, 32, and 33 permit intermixing of heated water within the tanks. This allows a business or industry to add additional units without requiring significant expense beyond the cost of the apparatus.

Conversely, if greater amounts of steam are desired from a single steam generating apparatus, a single holding tank 10 can be connected to two or more steam generation units 11.

Although preferred embodiments of the invention have been herein disclosed, it is to be understood that the present disclosure is made by way of example and that variations are possible without departing from the scope of protection defined in the attached claims.

I claim:

1. An apparatus for generating steam, comprising in combination:

water holding tank means;

steam generation means disposed below said water holding tank means, said steam generation means having a water reservoir and hollow cavity means above said reservoir for receiving and holding steam generated within said reservoir;

water feed means for alternatively introducing water into said steam generation means from said water holding tank means and from an outside water source;

heating means disposed below and in communication with said water reservoir; and a steam pipe extending from said cavity means upward through said water-holding tank for heating the water in said holding tank and for removing the steam from said cavity means.

2. An apparatus as set forth in claim 1, wherein said steam pipe extends back into said heating means for reheating the steam in said pipe.

3. An apparatus as set forth in claim 1, wherein a control valve is provided to regulate water flow from said holding tank to said steam generation means.

4. An apparatus as set forth in claim 1, wherein said holding tank contains baffles therein to maintain an approximately uniform temperature of the water throughout said holding tank.

5. An apparatus as set forth in claim 1, wherein at least two holding tanks are connected to said steam generation means.

6. An apparatus as set forth in claim 1, wherein at least two steam generating means are attached to said holding tank.

* * * * *